US005809674A

United States Patent [19]

Key

[11] Patent Number: 5,809,674

[45] Date of Patent: Sep. 22, 1998

[54] APPARATUS AND METHOD FOR INCREASING AN EFFECTIVE INFORMATION CARRYING SURFACE AREA ON A CONTAINER

[76] Inventor: Stephen M. Key, 10212 Whitetail Dr., Oakdale, Calif. 95361

[21] Appl. No.: 627,786

[22] Filed: Mar. 28, 1996

[51] Int. Cl.[6] ..... G09F 3/00

[52] U.S. Cl. ..... 40/306; 40/310; 40/506

[58] Field of Search ..... 40/506, 306, 312, 40/324, 661; 446/327, 321; 434/402, 427, 428; 206/459.5; 220/435

[56] References Cited

U.S. PATENT DOCUMENTS

| | | | |
|---|---|---|---|
| 1,064,576 | 6/1913 | Washburn . | |
| 1,312,611 | 8/1919 | Chess . | |
| 1,486,313 | 3/1924 | Antwerp . | |
| 2,013,616 | 9/1935 | Rettenmeyer . | |
| 2,441,607 | 5/1948 | Walls . | |
| 2,468,000 | 4/1949 | Taylor . | |
| 2,504,076 | 4/1950 | Lindblom . | |
| 2,706,464 | 4/1955 | North | 40/311 X |
| 2,739,564 | 3/1956 | North | 40/311 X |
| 2,844,893 | 7/1958 | Keller . | |
| 2,860,431 | 11/1958 | Barnum . | |
| 2,931,657 | 4/1960 | Lewis . | |
| 2,935,814 | 5/1960 | Freeze . | |
| 2,971,283 | 2/1961 | Parker . | |
| 3,278,182 | 10/1966 | Lescher . | |
| 3,374,911 | 3/1968 | White . | |
| 3,488,880 | 1/1970 | Taylor . | |
| 3,542,229 | 11/1970 | Beyerleda . | |
| 3,604,584 | 9/1971 | Shank . | |
| 3,733,002 | 5/1973 | Fujio . | |
| 3,960,713 | 6/1976 | Carey . | |
| 4,044,889 | 8/1977 | Orentreich . | |
| 4,381,615 | 5/1983 | Lonsmin . | |
| 4,405,045 | 9/1983 | Villa-Real . | |
| 4,877,119 | 10/1989 | Hosking . | |

FOREIGN PATENT DOCUMENTS

| | | | |
|---|---|---|---|
| 85214 | 3/1958 | Denmark . | |
| 1114750 | 4/1956 | France | 40/310 |
| 1347102 | 11/1963 | France . | |
| 2460260 | 1/1981 | France . | |
| 2677786 | 12/1992 | France . | |
| 327286 | 1/1935 | Italy | 40/506 |
| 1565 | 6/1888 | Sweden . | |

*Primary Examiner*—Cassandra H. Davis
*Attorney, Agent, or Firm*—Carr & Ferrell LLP

[57] ABSTRACT

A container has attached to its surface information fields containing information about the container's contents. A shell partially covered with an additional set of information fields and including a window is movably attached to the container so that when the shell is moved with respect to the container, the window reveals at least one of the information fields attached to the container surface. A method for manufacturing comprises the steps of affixing a first set of information fields to a container, defining a transparent window in a shell, and then disposing the shell around the container so that, in response to movement of the shell, the window reveals a variable subset of the information fields.

16 Claims, 10 Drawing Sheets

APPARATUS AND METHOD FOR INCREASING AN EFFECTIVE INFORMATION CARRYING SURFACE AREA ON A CONTAINER

CROSS-REFERENCE TO RELATED APPLICATIONS

The present application is related to and incorporates by reference pending U.S. patent application Ser. No. 08/558,743, filed Nov. 16, 1995, for an invention entitled "A System and Method for Using a Rotatable Device to Display Visual Artwork," by Stephen M. Key, and pending U.S. patent application Ser. No. (unknown), filed Feb. 08, 1996, for an invention entitled "System And Method Using A Rotatable Device For Presenting Information On A Pharmaceutical Container", also by Stephen M. Key.

BACKGROUND OF THE INVENTION

1. Field of the Invention

The present invention relates generally to devices and methods for labeling containers and more particularly for increasing an effective information carrying label area on a container.

2. Description of the Prior Art

Product packaging provides a limited surface area on which to display information to shoppers. Advertising information, such as a brand-name, features, certifications, awards or special offers displayed on a product's packaging enables manufacturers to establish and maintain a product image. As a product sits on a shelf, advertising information can catch a consumer's eyes and, upon closer examination, present product attributes favorably. Advertising information can determine whether a consumer purchases a product. Besides advertising information, the product packaging's limited area may be needed for required information, such as a Universal Product Code (UPC), warnings, instructions and manufacturer's information. Product packaging surfaces often offer less area than would be desired for these critical types of information. Furthermore, increasing government regulations for labeling and the "green/eco-" movement to reduce the total amount of packaging are likely to make packaging surfaces more crowded.

One way to display more information is to reduce the required labeling's "point size," but this discourages consumers from studying the text or graphics. Alternatively, required labeling information can be printed on a separate sheet of paper inside the product's packaging, but the information sheet can become separated from the product, which in the case of medical prescription products may cause serious problems.

U.S. Pat. No. 5,342,093, discloses a wrap-around label having a contact portion, an overlap portion, a transparent release coating, and an adhesive coating. The overlap portion may be peeled away from the contact portion to expose the front surface of the contact portion. Thus, both the overlap portion and the contact portion can display product information.

U.S. Pat. No. 5,154,448 discloses a layered scratch-off label in which a thin surface film can be scratched away to reveal an underlying layer. Thus, both the thin surface film and the second layer can display product information.

The peel-away and scratch-off approaches increase the effective surface area of packaging, but the product's original appearance is altered and the removed layers must be preserved or disposed of, thereby losing some information.

Furthermore, the two patent applications incorporated by reference above require bounding ridges or their equivalent to constrain a moveable information containing label. It would be useful to have a technique for affixing such moveable labels without employing such bounding ridges.

SUMMARY OF THE INVENTION

The present invention provides an apparatus and a method for providing an increased effective information carrying surface area on a container. The apparatus is preferably a package comprised of a container and a shell. The container's outer surface has applied directly to it one or more sets of information fields, preferably containing information about the package's contents. The shell also has a variety of product information visible on or through its outer surface. The shell is preferably formed of a shrink wrap material fitted to conform loosely to the contours of the container, so that the shell can rotate freely. Text and graphic information fields are affixed using conventional printing techniques on the shrink wrap. The shell preferably includes at least one transparent window which enables selective viewing of information on the package as the shell is rotated. A shell comprised of shrink-wrap material, when heated, conforms to and is secured by the container's surface features, without requiring bounding ridges or other mechanisms.

The method for manufacturing the present invention preferably begins with lithographing or silk-screening a first set of information fields to a container. An outer shell is formed of heat-shrink material, containing at least one transparent window, and information is added to the shell material using conventional printing techniques. Next the shell is positioned around the container and heated to shrink the shell to conform to the outer side of the container. Once the shell has cooled, then, as the shell is rotated, information displayed on the container surface can be viewed through the transparent window. Optionally, a lubricant can be applied to the container surface prior to shrinking the shell, to reduce friction between the shell and the container.

DETAILED DESCRIPTION OF THE PREFERRED EMBODIMENT

Figure 1:
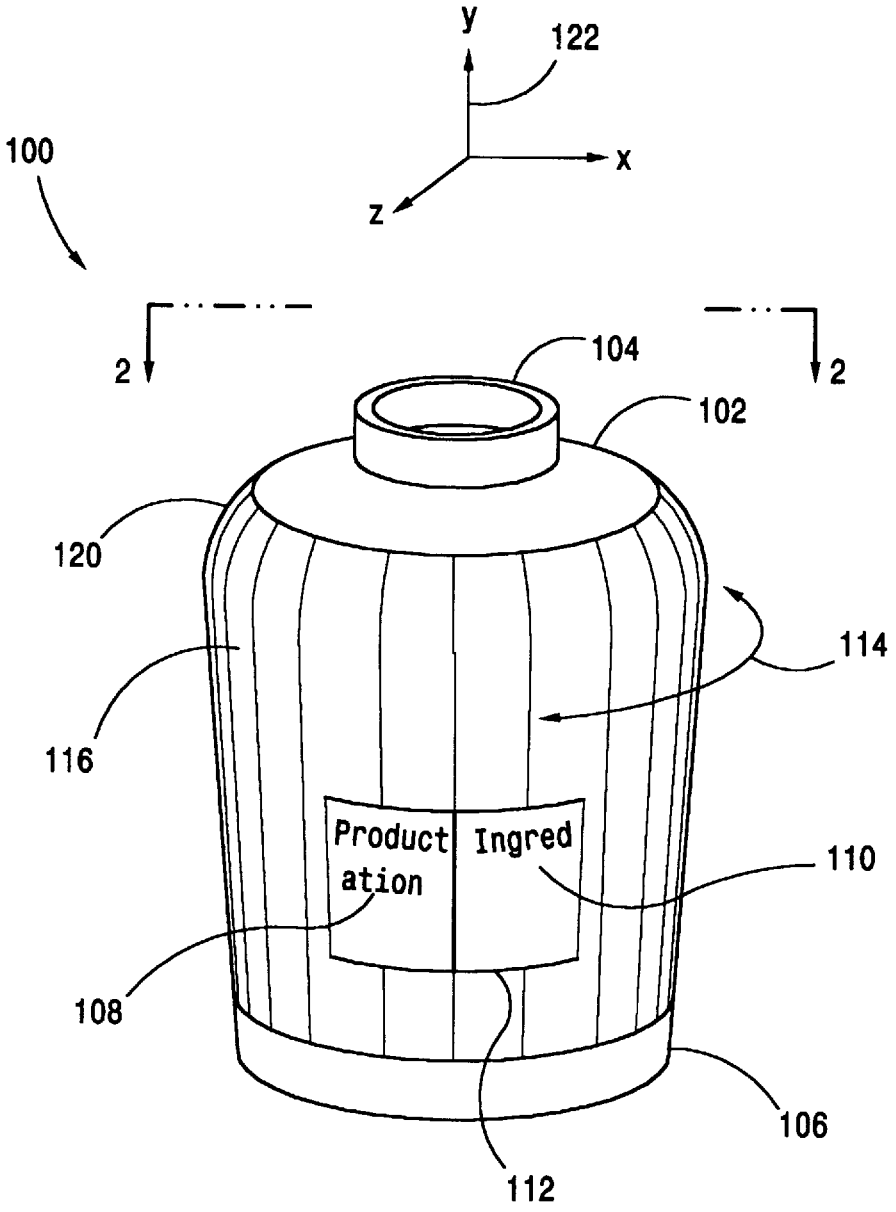
FIG. 1 is a pictorial diagram illustrating a preferred apparatus for providing an increased effective information carrying surface area on a container.

Referring now to FIG. 1, a pictorial diagram illustrating a preferred apparatus or package for providing an increased effective information carrying surface area for a container 102 is shown. The package 100 comprises a container 102 having a curved shoulder 120 and a bottom 106, a top portion 104, a set of information fields 108 and 110, and a shell 116 with a shell window 112. The container 102 may be formed of any suitable material including a flexible synthetic such as polypropylene or an acrylic resin, glass, plastic, organic, etc. The container 102 may itself be a food product, such as a banana or an apple. The set of information fields 108 and 110 may comprise one or any number of information fields, but for purposes of this disclosure only two fields (i.e. a first information field 108 and a second information field 110) are shown. The two information fields 108, 110 are portions of the container 102 surface, preferably between the top portion 104 and the bottom 106, onto which product information such as ingredients, advertisements, warnings, and so forth may be attached. Within each information field 108, 110 information may be attached or applied using any effective method, including a conventional silk-screening or lithographic process.

The shell 116 is disposed over the container 102 concentrically and is rotatable around a y-axis 122 of container 102 in response to a first rotation force 114. Below the curved shoulder 120 portion, the diameter of the shell 116 preferably decreases in a gradual taper towards the bottom 106. The shell 116 is preferably comprised of a "shrink-wrap" material (i.e. a heat-shrinkable PVC film such as "NINJA" film, manufactured by the Mitsubishi Group for Uniflex Corp. of Anaheim Hills, Calif.). The known conventional process for attaching shrink-wrap to the container 102 includes disposing the shrink-wrap over the container 102, heating the shrink-wrap to achieve a predetermined shrinkage about the container 102, and cooling the shrink-wrap. As the shrink-wrap shell is heated it conforms to surface features of container 102 and thus becomes the shell 116. The temperature and duration of heating determine the coefficient of friction between the container 102 and the shell 116.

The curved shoulder 120 and the downward taper of shell 116 together prevent shell 116 from detaching from container 102 and enable aligning the shell window 112 to the information fields 108, 110 on the container 102. The container 102 contours provide a means for keeping the shell 116 from sliding off of the container 102. If the container 102 does not have contours, then the shrink-wrap is extended past the top portion 104 and the bottom 106 of the container 102 to secure the shell 116 after the heating step. Those skilled in the art will recognize that, while present in the preferred embodiment, neither the curved shoulder 120 nor the shell 116's gradual taper are essential to practicing the present invention.

The shell 116 inner and/or outer surface is selectively covered with textual or graphic information. The information on the shell 116 is also preferably applied to the inside surface (i.e. the surface facing the container 102) of the shell 116 using conventional silk-screening or lithographic methods. Shell 116 also includes a transparent shell window 112. Most of the shell 116 area is preferably covered with information but the shell window 112 is preferably transparent to permit the information fields 108, 110 to be viewed through shell window 112 selectively as the shell 116 is rotated around the container 102. The shell window 112 is preferably a contiguous part of the shell 116 and does not form a hole or aperture through the shell 116, thus preventing foreign objects and moisture from entering the area between the container 102 and shell 116. Alternatively, the shell window 112 could be formed by cutting out a section of the shell 116. Although use of the transparent shell window 112 is preferred to a cut-out section formed in the shell 116, use of a cut-out has the advantage of possibly lowering production costs under some circumstances. While only one shell window 112 is shown in FIG. 1, alternatively shell 116 could comprise multiple shell windows, each at a given time revealing a different set of information fields on the container 102.

The freedom of shell 116 to rotate around the container 102 can be ensured by:

- applying to the inner surface of shell 116 a "facilitating" ink which dries slick and thereby facilitates slippage of the shell 116 against the container 102 or alternatively, by applying facilitating ink also to the outer surface of the container 102;
- heating the shrink-wrap less so that it shrinks less (this is currently the preferred embodiment);
- using a bigger shrink-wrap sleeve so that when the shrink-wrap is heated it does not shrink as tightly around container 102; and
- sealing the container before applying the shrink-wrap so that, during application of the shrink-wrap, heating causes the container 102 to expand slightly and limit shrinkage of the shrink-wrap, thereby, after the shrink wrap and container 102 cools, permitting the shell 116 to freely rotate around the container 102.

Figure 2:
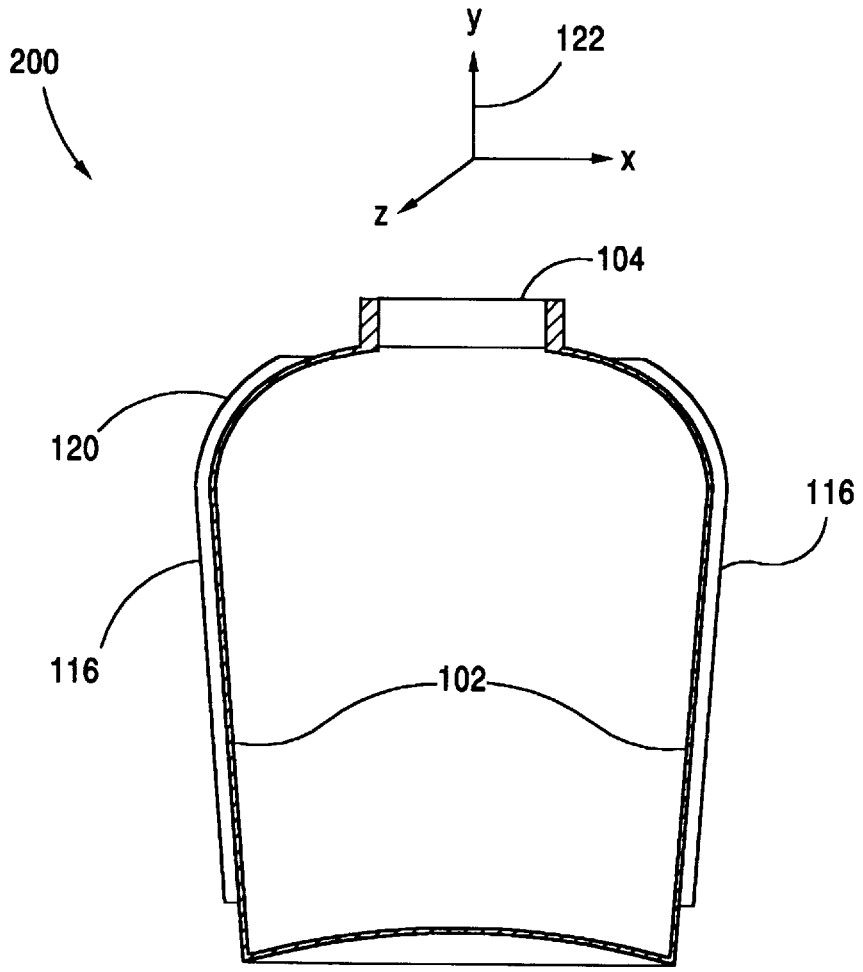
FIG. 2 is a cross-sectional view of the preferred embodiment shown in FIG. 1.

FIG. 2 shows a cross-section 200 of the preferred embodiment 100 of FIG. 1. The curved shoulder 120 portion of the shell 116 prevents the shell 116 from moving downward toward the container bottom 106. The tapered portion of shell 116 prevents the shell from moving upward. Thus, due to the curved shoulder 120 portion and the tapered portion, the shell 116 remains secured to the container 102 in the direction along the y-axis 122.

Figure 3:
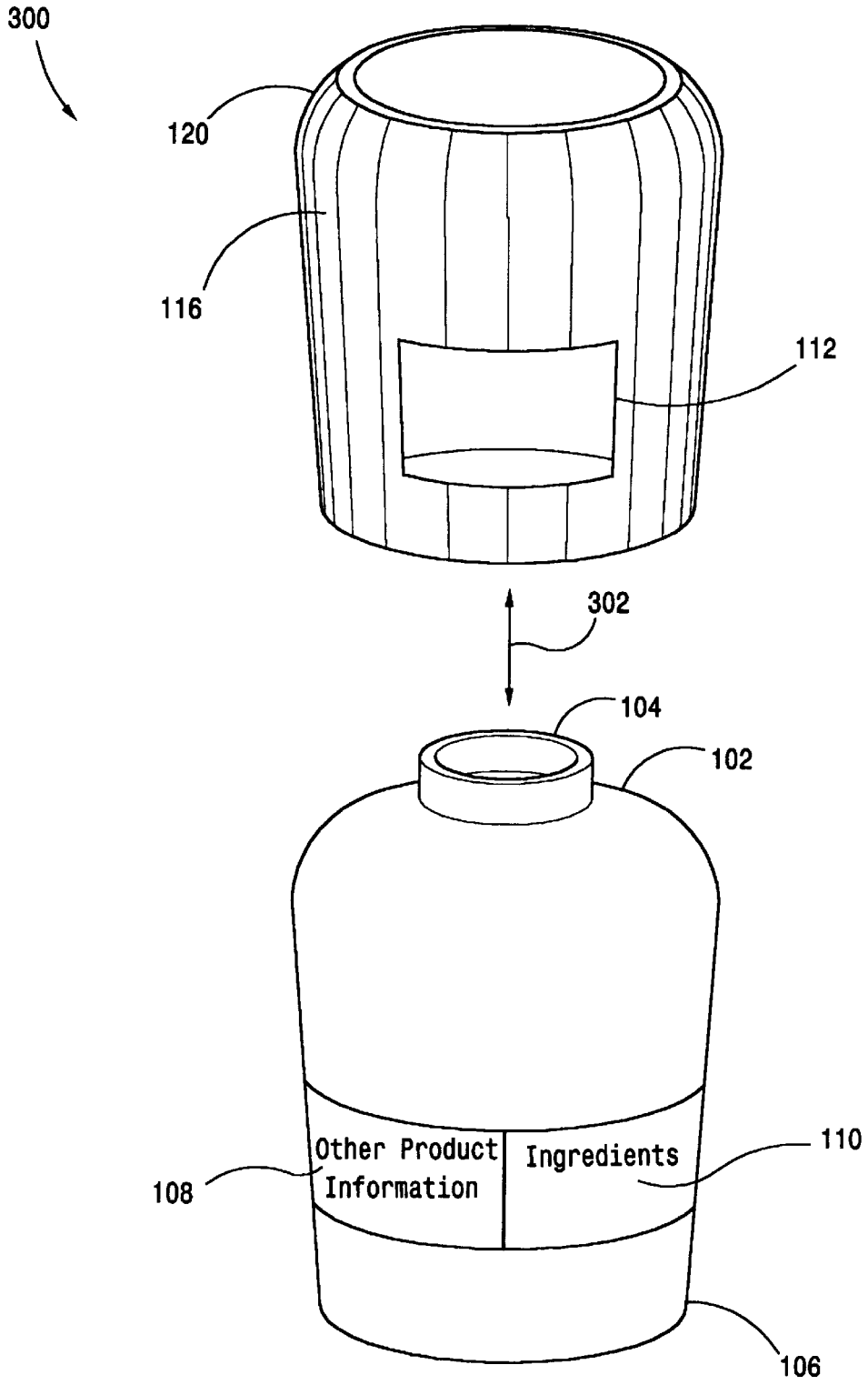
FIG. 3 is an exploded view of the preferred embodiment shown in FIG. 1.

FIG. 3 is an exploded view 300 of the preferred embodiment of FIG. 1 showing the shell 116 detached from the container 102 to reveal the container's 102 two information fields 108 and 110.

Different information fields are seen through the shell window 112 depending upon the relative position of shell 116 with respect to container 102. Thus, starting from the position shown in FIG. 1, if the shell 116 is rotated clockwise (as viewed from above the top portion 104 looking downward) around the y-axis 122 in response to a first rotation force 114, as indicated by the arrow in FIG. 1, then the first information field 108 containing "Other Product Information" will become centered in shell window 112. Starting again from the position shown in FIG. 1, if alternatively the shell 116 is rotated counter-clockwise, then the second information field 110 containing "Ingredients" will become centered in the shell window 112.

Alternatively, an information field on the container 102 may be a transparent container window (not shown) that permits the product or contents of the package 100 to be seen through the shell window 112 by a shopper. The container window may also be used to permit exposure of the contents of the package 100 during quality control operations. For example, to verify that the contents are of a uniform color or consistency, an energy source (such as visible light, ultraviolet light, infra-red light, heat, radiation, or the like) may expose the contents through the shell window 112, while a monitoring device records light or energy reflected from the contents of the package 100.

Figure 4:
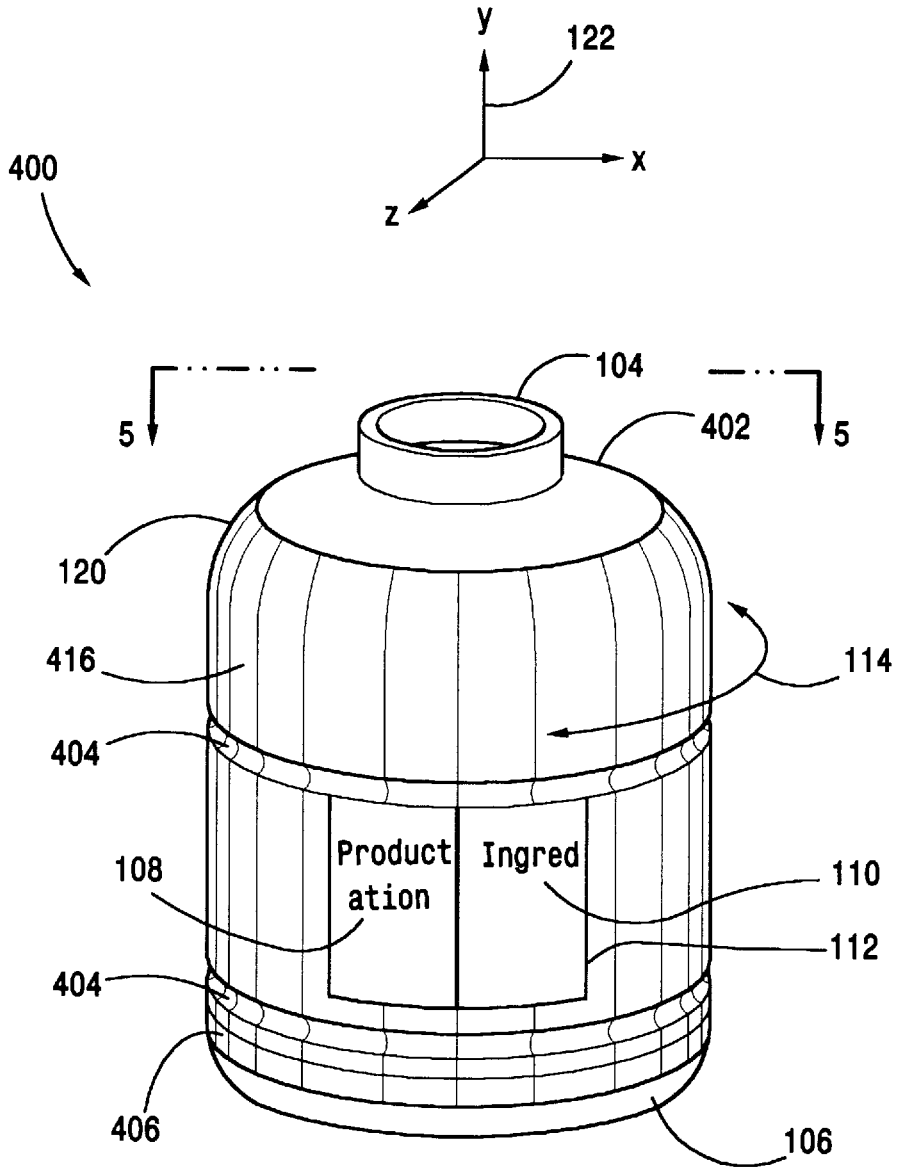
FIG. 4 is a pictorial diagram of a first alternate embodiment.

Referring now to FIG. 4, a pictorial diagram of a first alternate embodiment 400 is shown. In the first alternate embodiment 400, the preferred shell 116 of FIG. 1 is replaced by a first alternate shell 416 which preferably retains all of the properties of shell 116, except that first alternate shell 416 does not have the taper of the shell 116 and instead comprises a set of latitudinal ridges 404 and a curved base 406 which provide an additional means for securing the first alternate shell 416 to a first alternate container 402. The first alternate shell 416 remains rotatable in response to the first rotation force 114 around the y-axis 122.

Figure 5:
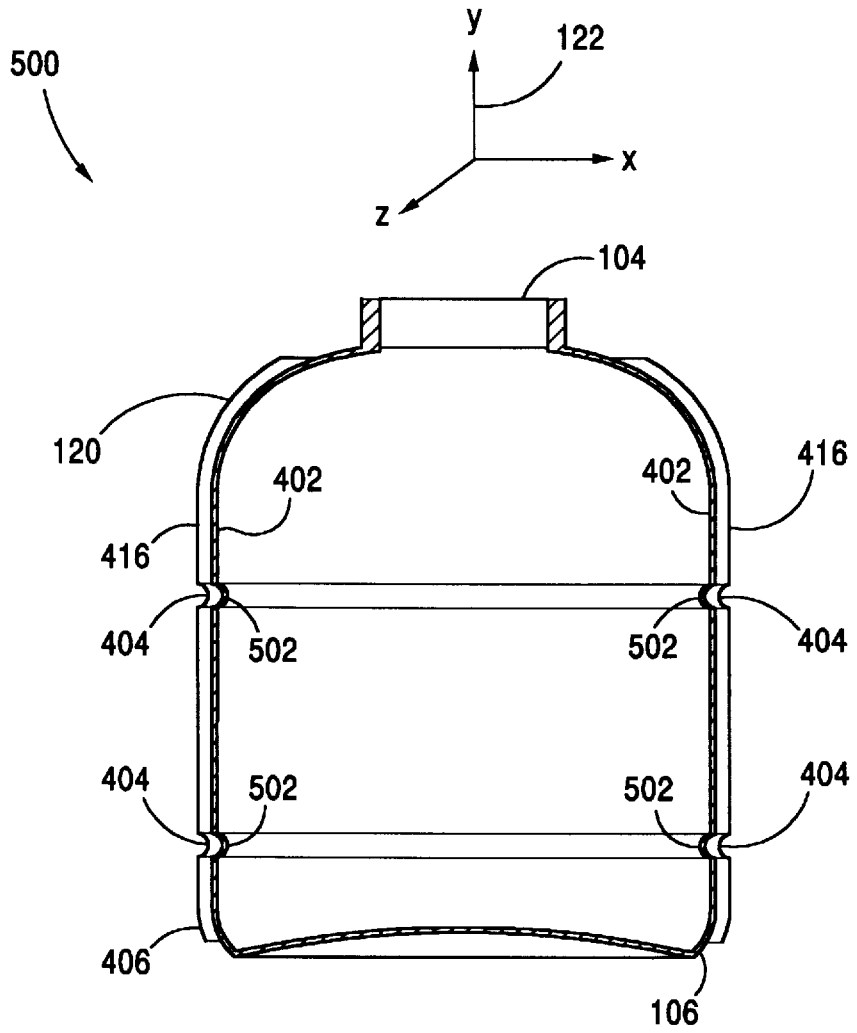
FIG. 5 is a cross-sectional view of the first alternate embodiment shown in FIG. 4.

Referring now to FIG. 5, a cross-sectional view of the first alternate embodiment 500 of FIG. 4 is shown. The first alternate container 402 further comprises a set of latitudinal indents 502. As discussed above, the shrink-wrap that eventually forms the first alternate shell 416 when heated conforms to the shape of the first alternate container 402. Thus the rounded surface near the top portion 104 of the first alternate container 402 enables the curved shoulder 120 of first alternate shell 416 to be formed, the set of indents 502 enables the set of ridges 404 to be formed, and the curved bottom 106 of the container 412 enables the curved base 406 portion of first alternate shell 416 to be formed.

The set of indents 502 interlock concentrically with the set of ridges 404 to secure the shell 416 to the container 402 in the direction along the y-axis 122 of the container 402, while permitting the shell 416 to rotate around y-axis 122 of container 402 so that shell window 112 selectively displays different information fields 108, 110. A shell can be movably attached to a container alternately by equivalent devices, including, instead of the set of ridges 404 and indents 502, sets of dimples on the container and on the shell, thereby permitting a range of incremental movement around and along the y-axis 122 of the container. Dimples are defined as half-spherical structures formed on the container and projecting either outwardly or inwardly from the container's outer surface. The dimples may alternatively be formed in other geometrical shapes.

Figure 6:
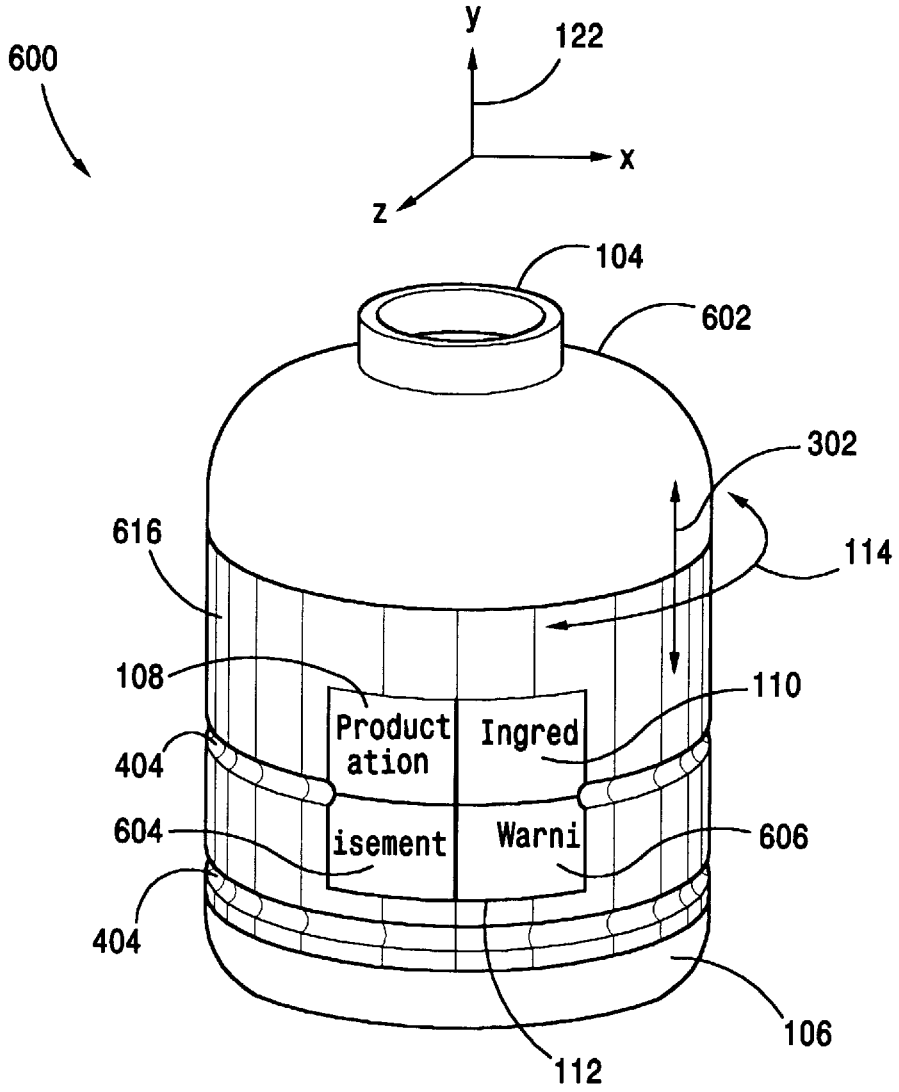
FIG. 6 is a pictorial diagram of a second alternate embodiment.

Referring now to FIG. 6, a pictorial diagram of a second alternate embodiment 600 is shown. In the second alternate embodiment 600, the first alternate shell 416 of the first alternate embodiment of is replaced by a second alternate shell 616 and two more information fields (a third information field 604, a fourth information field 606) are added. The second alternate shell 616 preferably retains all properties of the first alternate shell 416, except for eliminating the curved shoulder 120 and the curved base 416 so that the second alternate shell 616 may now be responsive to the translation force 302 along the y-axis 122. The translation force 302 can incrementally move the second alternate shell 616 along the y-axis 122 of a second alternate container 602. The shrink-wrap forming the second alternate shell 616 is preferably sufficiently elastic to permit the set of indents 502 to de-couple from the set of ridges 404 and permit the second alternate shell 616 to move along the y-axis 122.

One of the four information fields 108, 110, 604, 606 is revealed through the shell window 112 depending upon the relative position of second alternate shell with respect to the second alternate container 602. Thus, starting from the shell window 112 position shown in FIG. 6, if the second alternate shell 616 is rotated clockwise (as viewed from the top portion 104 of the second alternate container 602 and looking downward) around the y-axis 122 in response to a rotational force as indicated by arrow 114, and translated upward along the y-axis 122 in response to the translation force 302, then the first information field 108 containing "Other Product Information" will become centered the shell window 112. Starting again from the shell window 112 position shown in FIG. 6, if the second alternate shell 616 is rotated counter-clockwise around the y-axis 122 and translated upward along y-axis 122, then the second information field 110 containing "Ingredients" will become centered in the shell window 112. Thirdly, starting from the shell window 112 position shown in FIG. 6, if the second alternate shell 616 is rotated clockwise around y-axis 122 and translated downward, then the third information field 604 containing "Advertisement" will become centered in the shell window 112. Lastly, starting from the shell window 112 position shown in FIG. 6, if the second alternate shell 616 is rotated counter-clockwise and translated downward, then the fourth information field 606 containing "Warnings" will become centered in the shell window 112.

Figure 7:
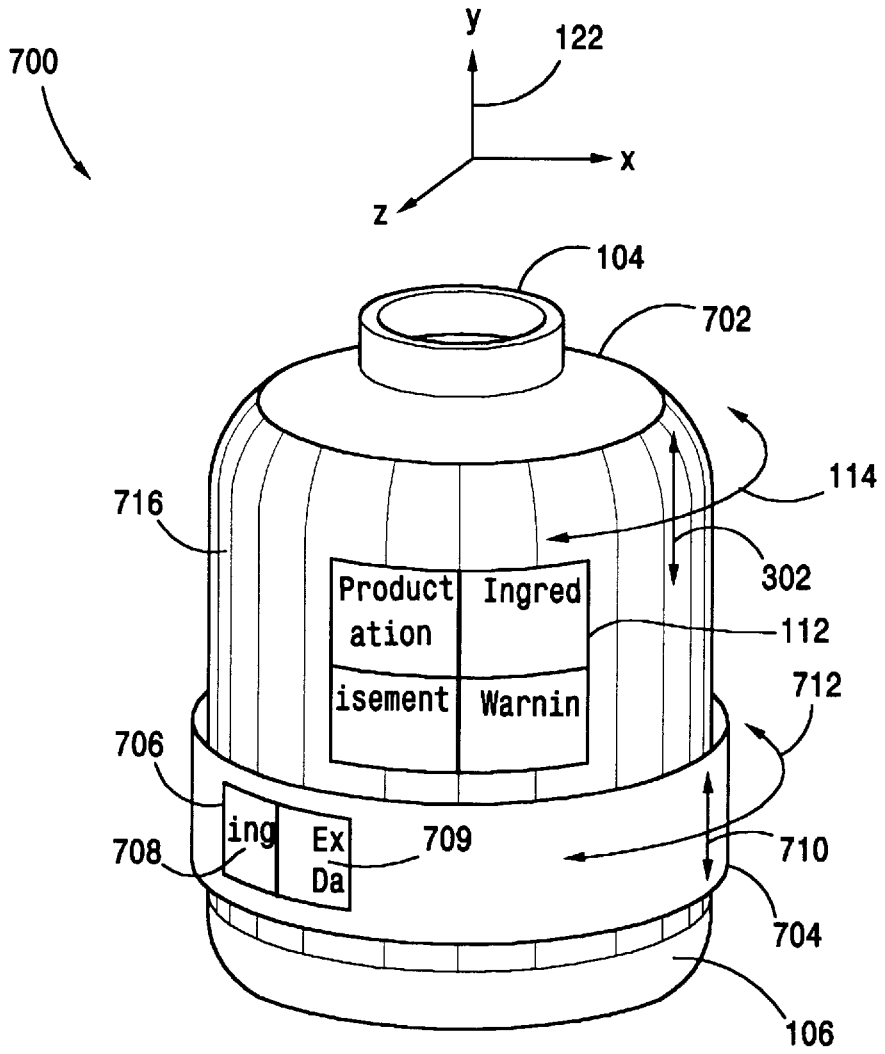
FIG. 7 is a pictorial diagram of a third alternate embodiment.

FIG. 7 shows a pictorial diagram of a third alternate embodiment 700 in which the preferred shell 116 is replaced by a inner shell 716 and by an outer shell 717 which each preferably include the properties of shell 116, with the following differences. While the inner shell 716 moves with respect to the third alternate container 702 in the same manner as the preferred shell 116, the inner shell 716 further comprises a fifth information field 708 and a sixth information field 709 (See FIG. 8) comparable to the four information fields 108, 110, 604, 606, but preferably containing additional information. The outer shell 717 is movably attached to, and concentrically encircles, the inner shell 716. The outer shell 717 comprises an outer shell window 706 that, depending upon the outer shell's 717 relative position with respect to the inner shell 716, selectively displays the fifth and sixth information fields 708, 709.

As the outer shell 717 is heat shrunk around the inner shell 716, the inner shell 716 is also shrunk by an additional amount. Thus, when the inner shell 716 is first attached to the container 702, the duration of heating should be reduced by a time sufficient to allow for the additional heating experienced during heat shrinkage of the outer shell 717. Furthermore, a friction inhibiting substance may be applied to the outer surface of the inner shell 716 to prevent the outer shell 717 from sticking to inner shell 716 during the heating step.

Thus, starting from the outer shell window 706 position shown in FIG. 7, if in response to a second rotation force 712 the outer shell 717 is rotated clockwise (as seen from above top portion 104 looking downward) around the y-axis 122 while not experiencing a second translation force 710, then the fifth information field 708 containing "Manufacturing Date" will be displayed in the outer shell window 706. However, if instead the outer shell 717 is rotated counter-clockwise around the y-axis 122 in response to a second rotation force 712, then the sixth information field 709 containing "Expiration Date" will be centered in the outer shell window 706. According to the movement of the inner shell 716 with respect to the container 702 and the movement of the outer shell 717 with respect to the inner shell 716, each of the four information fields 108, 110, 604, 606 and the fifth and sixth information fields 708, 709 may be displayed through the shell window 112 and/or the outer shell window 706. Those skilled in the art will recognize that additional tapered or straight shells may be movably attached to either the container 702, the inner shell 716, the outer shell 717, and so on.

Figure 8:
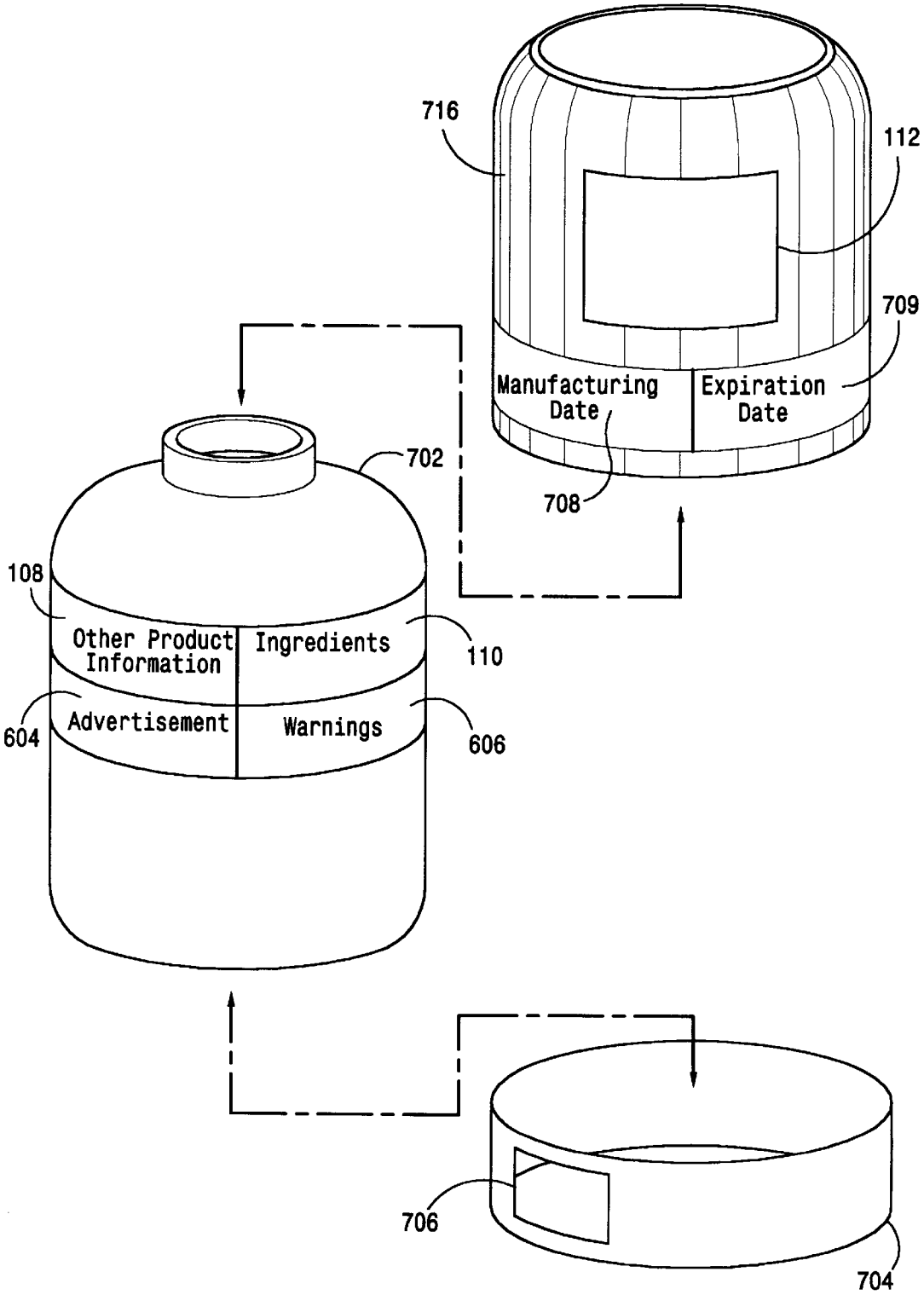
FIG. 8 is an exploded view of the third alternate embodiment shown in FIG. 7.

FIG. 8 is an exploded view of the third alternate embodiment 700, with the inner shell 716 detached from the third alternate container 702 to show the third alternate container's 702 four information fields 108, 110, 604, 606. The outer shell 717 is also shown detached from the inner shell 716 so that the inner shell's 716 fifth and sixth information fields 708, 709 may be clearly seen.

Figure 9:
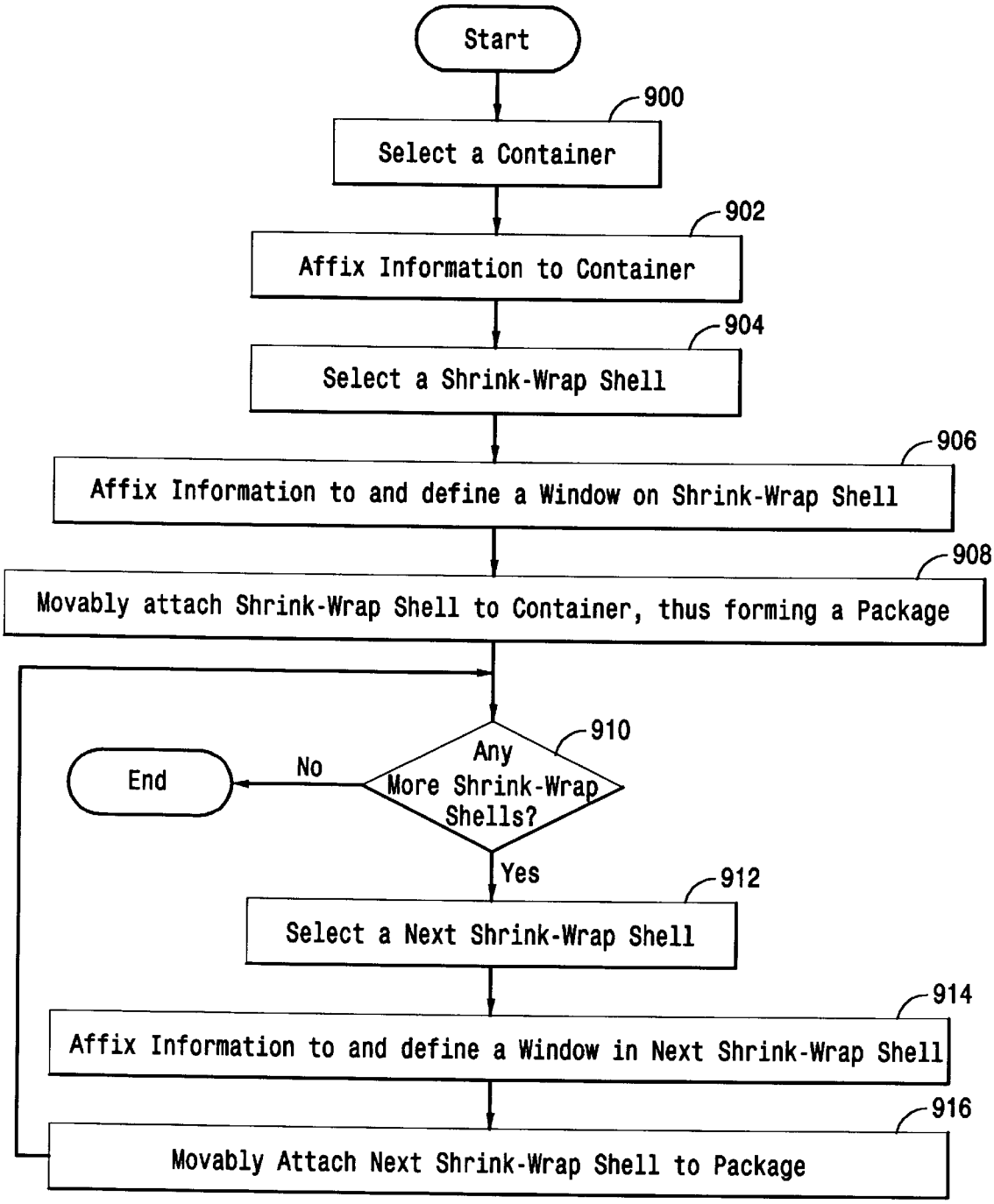
FIG. 9 is a flowchart illustrating a preferred manufacturing of the present invention.

FIG. 9 is a flowchart illustrating a preferred method for manufacturing the present invention. The method begins in step 900 by selecting a container 102. Next, in step 902, a first set of information fields, containing either graphic or textual information, is affixed to the container 102 by for example a lithographic or silk-screen process. In step 904, a shrink-wrap material is selected from which to form the shell 116. In step 906, a second set of information fields, containing either graphic or textual information, is affixed to the shrink-wrap shell, for example by a lithographic or silk-screen process. In step 908, the shrink-wrap is movably attached to the container 102 to form the package 100, such as by disposing the shrink-wrap material over the container 102, applying heat until the shrink-wrap conforms to the surface features of the container 102 while still being able to rotate around the container 102, and then cooling the shrink wrap and the container 102. During the course of heating in step 908 the shrink-wrap material becomes the shell 116. In step 910, if additional shrink-wrap shells are to be applied, the method proceeds to step 912, else the method ends. In step 912, a next shrink-wrap shell is selected from which to form the outer shell 704. In step 914, a next set of information fields, containing either graphic or textual information, is affixed to the outer shell 704, again by for example lithographic or silk-screen process. In step 916, the next shrink-wrap shell is movably attached to the inner shell 702 to form the outer shell 704, such as by coating a friction inhibitor substance onto the shrink-wrap material already movably attached to the container 102, disposing the shrink-wrap material over the container 102, heating until the shrink-wrap conforms to the surface features of the container 102 while still being able to rotate around the container 102, and then cooling the shrink wrap and container 102. After step 916, the preferred method returns to step 910.

Figure 10:
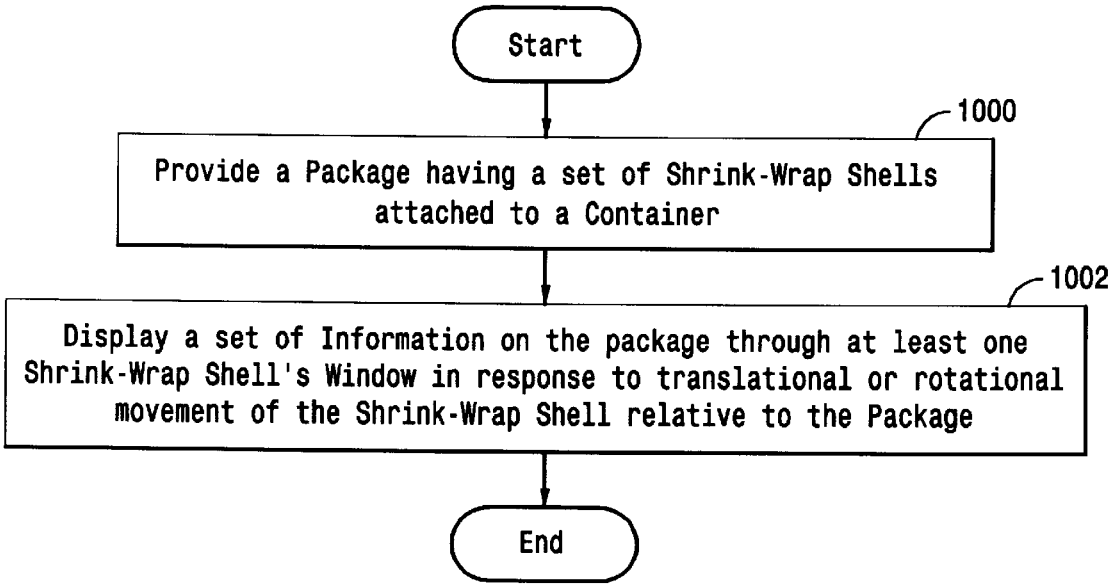
FIG. 10 is a flowchart of a preferred method for using the apparatus of FIG. 1.

Referring now to FIG. 10, a flowchart of a preferred method for using the apparatus of FIG. 1 begins in step 1000 where the package 100 having one or more shrink-wrap shells attached to the container 102 is provided. Next, in step 1002, in response to either translational or rotational forces on the shrink-wrap shell's window the package 100 displays a set of information through at least one shrink-wrap shell's window, depending on the shrink-wrap shell window's position with respect to the container and any underlying shrink-wrap shells. After step 1020, the preferred method ends.

While the present invention has been described with reference to certain preferred embodiments, those skilled in the art will recognize that various modifications may be provided. For example, although the preferred embodiment describes translatable and rotatable shells disposed on cylindrical containers, those skilled in the art will recognize that the present invention may also be embodied on flat surfaced containers and packages. In a flat surface embodiment, a flat window may be selectively moved to reveal information on a flat label.

Variations upon and modifications to the preferred embodiments are provided for by the present invention, which is limited only by the following claims.

What is claimed is:

1. An apparatus, for increasing an effective information carrying surface area, comprising:

a container having a top portion, a bottom portion, a longitudinal axis extending therebetween and surface irregularity;

a set of information fields arranged circumferentially about an outer surface of the container;

an opening, disposed at the top portion of the container, to enable dispensing of contents of the container;

a non-transparent heat shell comprising a heat shrinkable material heat shrunk onto the container, such that the shell is rotatable relative to the container about the longitudinal axis, the shell being adapted at an end thereof with an aperture to permit access to the opening;

a window disposed in the shell which selectively displays at least one information field in response to rotation of the shell with respect to the container; and the shell conforming to the surface irregularity, the surface irregularity being at least partially covered by an inner surface of the shell, whereby movement of the shell along the longitudinal axis is restricted.

2. The apparatus of claim 1, wherein the container is comprised of one from a group consisting of metal, glass, plastic, and organic materials.

3. The apparatus of claim 1, wherein the plurality of information fields is comprised of one from a group consisting of alphanumeric information and graphic information.

4. The apparatus of claim 1, wherein the plurality of information fields is comprised of one from a group consisting of product information, ingredients, an advertisement, a warning, and a date.

5. The apparatus of claim 1, wherein the plurality of information fields is affixed to the outer surface of the container using an adhesive.

6. The apparatus of claim 1, wherein:

the surface irregularity comprises a plurality of latitudinal indents;

the shell further comprises a plurality of latitudinal ridges corresponding to and cooperating with the plurality of latitudinal indents; and the shell is translatable in discrete increments along the longitudinal axis of the container.

7. The apparatus of claim 1, wherein the surface irregularity includes one from a group consisting of a taper, a ridge, a dimple and an indentation.

8. A method, for providing an increased effective information carrying surface area, comprising the steps of:

providing a container having opposed ends and a longitudinal axis extending therebetween, the container further having an opening disposed at one of the ends for dispensing contents of the container and a surface irregularity formed on the container;

arranging a plurality of information fields circumferentially about an outer surface of the container;

providing a non-transparent shell having a transparent window and an inside surface, the shell being adapted at an end thereof with an aperture allowing access to the opening, the shell comprising a heat shrinkable wrap material shrunk onto the container and having an inside surface conforming to at least part of the surface irregularity such taht rotation of the shell relative to the container causes the window to reveal a at least one of the plurality of information fields; and whereby movement of the shell along the longitudinal axis is restricted.

9. The method of claim 8, wherein the surface irregularity comprises a plurality of latitudinal indents, and further comprising the step of forming a plurality of ridges on the inside surface of the shell corresponding to and cooperating with the plurality of latitudinal indents, wherein the plurality of ridges interlocking the plurality of indents with the plurality of ridges so that the shell is incrementally translatable with respect to the container.

10. A system for increasing an effective information carrying surface area, comprising:

a container having a first and a second end, a longitudinal axis extending therebetween and surface irregularity;

a plurality of information fields arranged circumferentially about an outer surface of the container;

means for dispensing contents of the container, the dispensing means being disposed at one of the first and second ends;

a non-transparent shell comprising a heat shrinkable material heat shrunk onto the container, such that the shell is rotatable relative to the container about the longitudinal axis, the shell being adapted at an end thereof with an aperture to permit access to the dispensing means;

means disposed in the shell for selectively displaying to a viewer at least one information field in response to rotation of the shell with respect to the container; and the shell conforming to the surface irregularity to thereby inhibit movement of the shell relative to the container along the longitudinal axis.

11. The system of claim 10, wherein the container is comprised of one from a group consisting of metal, glass, plastic, and organic materials.

12. The system of claim 10, wherein the plurality of information fields is comprised of one from a group consisting of alphanumeric information and graphic information.

13. The system of claim 10, wherein the plurality of information fields is comprised of one from a group consisting of product information, ingredients, an advertisement, a warning, and a date.

14. The system of claim 10, wherein the plurality of information fields is affixed to the outer surface of the container using an adhesive.

15. The system of claim 10, wherein:

the surface irregularity comprises a plurality of latitudinal indents;

the shell further comprises a plurality of latitudinal ridges corresponding to and cooperating with the plurality of latitudinal indents; and the shell is translatable in discrete increments along the longitudinal axis of the container.

16. The system of claim 10, wherein the surface irregularity includes one from a group consisting of a taper, a ridge, a dimple and an indention.

* * * * *

UNITED STATES PATENT AND TRADEMARK OFFICE

CERTIFICATE OF CORRECTION

PATENT NO : 5,809,674

DATED : 9/22/98

INVENTOR(S) : Stephen M. Key

It is certified that error appears in the above-identified patent and that said Letters Patent is hereby corrected as shown below:

In col. 6, lines 16, 24, 26, 27, 30, 35, 38, 42, 47, 53, 60, and 65, the reference number "717" should be replaced with reference number --704--.

Signed and Sealed this

Twenty-third Day of March, 1999

*Attest:*

Q. TODD DICKINSON

*Attesting Officer*

*Acting Commissioner of Patents and Trademarks*